US005934363A

United States Patent [19]

Jung et al.

[11] Patent Number: 5,934,363

[45] Date of Patent: Aug. 10, 1999

[54] HEAT EXCHANGER FIN HAVING AN INCREASING CONCENTRATION OF SLITS FROM AN UPSTREAM TO A DOWNSTREAM SIDE OF THE FIN

[75] Inventors: Gyoo Ha Jung, Suwon; Sung Han Jung, Anyang, both of Rep. of Korea

[73] Assignee: Samsung Electronics Co., Ltd., Suwon, Rep. of Korea

[21] Appl. No.: 09/084,878

[22] Filed: May 28, 1998

[30] Foreign Application Priority Data

May 30, 1997 [KR] Rep. of Korea ..... 97-21880

[51] Int. Cl.[6] ..... F28F 1/32

[52] U.S. Cl. ..... 165/146; 165/151; 165/DIG. 503

[58] Field of Search ..... 165/151, 146

[56] References Cited

FOREIGN PATENT DOCUMENTS

| | | | |
|---|---|---|---|
| 59-74498 | 4/1984 | Japan | 165/151 |
| 60-33495 | 2/1985 | Japan | 165/151 |
| 61-153498 | 7/1986 | Japan | 165/151 |
| 61-240099 | 10/1986 | Japan | 165/151 |
| 61-265497 | 11/1986 | Japan | 165/151 |
| 63-201496 | 8/1988 | Japan | 165/151 |
| 1-305297 | 12/1989 | Japan | 165/151 |
| 2-64397 | 3/1990 | Japan | 165/151 |

*Primary Examiner*—Allen Flanigan
*Attorney, Agent, or Firm*—Burns, Doane, Swecker & Mathis, L.L.P.

[57] ABSTRACT

A heat exchanger includes parallel fins and coolant-conducting tubes extending perpendicularly therethrough. There are three rows of the tubes, the three rows disposed in first, second and third sections, respectively, of the fin. The three fin sections are arranged sequentially from an upstream side to a downstream side of the fin, whereby the first section defines the upstream side, the third section defines the downstream side, and the second section is situated intermediate the first and third sections. The second and third sections have slits formed therein, whereas the first section is slit-free. The number of slits in the second section is from 50 to 80 percent of the number of slits in the third section, so that the air flow resistance is highest in the third section where the differential between air temperature and tube temperature is smallest.

4 Claims, 4 Drawing Sheets

HEAT EXCHANGER FIN HAVING AN INCREASING CONCENTRATION OF SLITS FROM AN UPSTREAM TO A DOWNSTREAM SIDE OF THE FIN

BACKGROUND OF THE INVENTION

1. Field of the Invention

The present invention relates to a heat exchanger, and more particularly, to a heat exchanger fin structure.

2. Description of the Related Art

A fin tube type heat exchanger functioning as an evaporator or condenser in an air conditioner or a refrigerator includes a plurality of heat exchange tubes arranged in parallel with each other in a plurality of rows and a plurality of plate-shaped fins spaced by an interval for conducting an air flow and arranged in parallel with each other perpendicular to the heat exchange tubes. The fins have a plurality of throughholes through which the heat exchange tubes are passed. A coolant flowing through the heat exchange tubes exchanges heat with air forcedly blown by an air blower transversely with respect to the longitudinal direction of the heat exchange tube, that is along the plate surface of the fin.

FIG. 5 is a plan view partially showing a conventional fin for use in a heat exchanger, and FIG. 6 is a partially sectional view taken along line II—II of FIG. 5. As can be seen from FIGS. 5 and 6, a plate-shaped fin 71 includes a plurality of throughholes 75 for passage of heat exchange tubes for transferring a coolant and a plurality of slit protuberance portions 77 and 79 protruding from a fin base 73 defining slits extending transversely with respect to the air flowing direction of the fin base 73. These slit protuberance portions 77 and 79 protrude alternately from both plate surfaces along the air flowing direction. Accordingly, the flow of the air flowing along the plate surface curves up and down with respect to the plate surface of the fin base 73 and the air exchanges heat with the coolant in the heat exchange tubes as shown in FIG. 6.

The conventional fin 71 of FIG. 5 includes three fin sections 81, 83 and 85 in which three heat exchange tube rows transversely arranged in parallel with respect to the air flowing direction are formed, respectively. An equal number of the slit protuberance portions 77 and 79 are formed in each of the fin sections 81, 83 and 85.

By the way, in the case of the fin 71 for use in the heat exchanger, since the difference in temperature between the air and the coolant in the upstream fin section 81 is large, the amount of heat exchange is comparatively large, while since the difference in temperature between the air and the coolant in the downstream fin section 85 is small, the amount of heat exchange is comparatively small. The deviation of the heat exchange amount lowers a heat exchange efficiency of each fin or the whole heat exchanger.

For example, assuming that the heat exchanger is used as a condenser of an air conditioner and has the conventional fin 71 in which the number of slit protuberance portions 77 and 79 is uniform, when the temperature of the heat exchange tube and the fin is about 70° C., the temperature of the outer air before passing through the heat exchanger is about 30° C. and the humidity is about 75%, it has been proved experimentally that approximate 50–70% of the total heat exchange amount is accomplished in the first fin section 81, approximate 30% thereof is accomplished in the second fin section 83 and approximate 10% thereof is accomplished in the third fin section 85.

In particular, when a heat exchanger is used as an outdoor heat exchanger during heating operation in an air conditioner operating as a cooler and heater in combination, there is a high possibility that a layer of frost will be formed on the fin section 81 of the entrance side having a large amount of heat exchange due to the low ambient temperature and the evaporation latent heat of the coolant, compared to that of the fin section 85 of the exit side having a small amount of heat exchange. The frost stops up the slit protuberance portions and hinders air from flowing, to thereby adversely affect the heat exchange at the fin sections 83 and 85. Such a problem can occur likewise when a heat exchanger is used as an evaporator for use in a refrigerator.

SUMMARY OF THE INVENTION

To solve the above problems, it is an object of the present invention to provide a heat exchanger which can perform a uniform and efficient heat exchange over the whole surface of fins.

To accomplish the above object of the present invention, there is provided a heat exchanger comprising: a plurality of heat exchange tubes arranged in parallel with each other in at least three rows; and a plurality of plate-shaped fins spaced apart and arranged in parallel with each other perpendicular to the heat exchange tubes. Each fin has a plurality of throughholes through which the heat exchange tubes are passed, wherein each fin comprises a plurality of slit protuberance portions protruding from the plate surface to define slits extending transversely to the air flowing direction. The number of the slit protuberance portions formed in each row of the heat exchange tube is gradually increasing along the air flowing direction. No slit protuberance portions are formed in a first heat exchange tube row disposed at the leading end in an air flowing direction. The number of the slit protuberance portions in a second heat exchange tube row is approximate 50% to 80% of the number of the slit protuberance portions in a third heat exchange tube row, in order to prevent an increase in air flowing resistance during frosting.

Each fin comprises a plurality of fin sections to which at least one heat exchange tube belongs, and at least one part of the fin sections is preferably separately manufactured with respect to the remaining fin sections and connected thereto.

For an efficient heat exchange, the slit protuberance portions can be arranged in an arc shape along the circumference of the adjacent throughholes.

BRIEF DESCRIPTION OF THE DRAWINGS

The above object and advantages of the present invention will be apparent by describing the structure and operation thereof in detail with reference to the attached drawings in which.

DETAILED DESCRIPTION OF THE INVENTION

Figure 1:
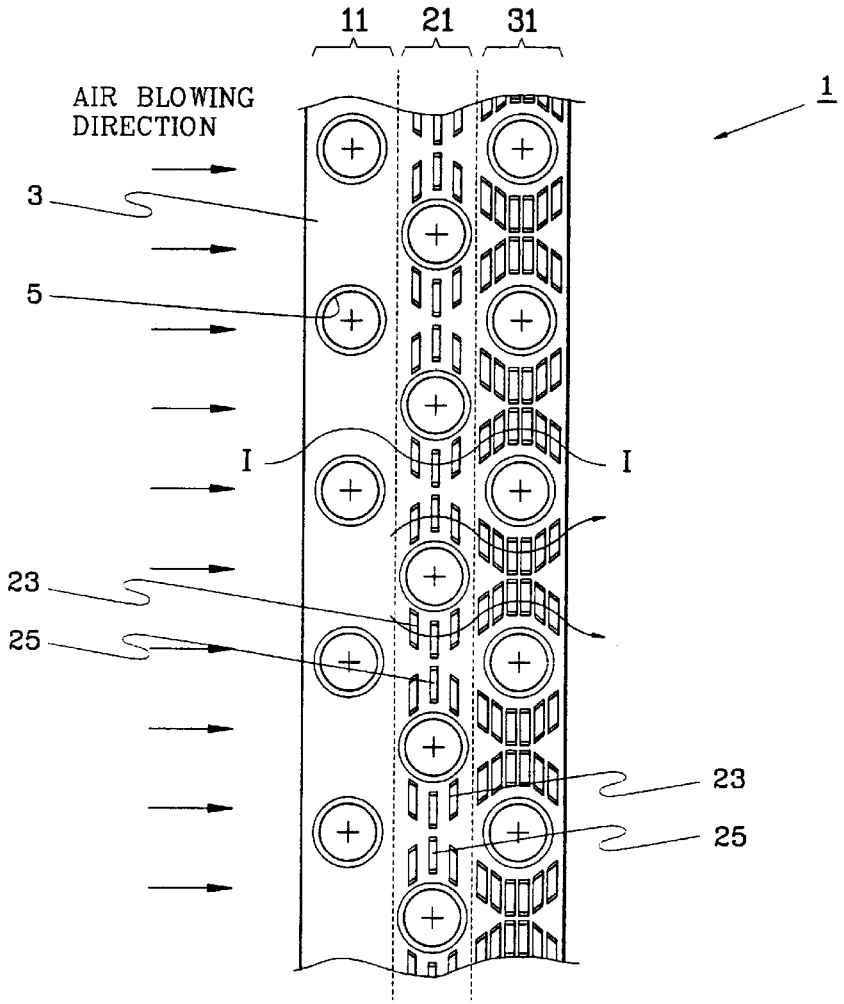
FIG. 1 is a plan view partially showing a fin for use in a heat exchanger according to an embodiment of the present invention.
Figure 3:
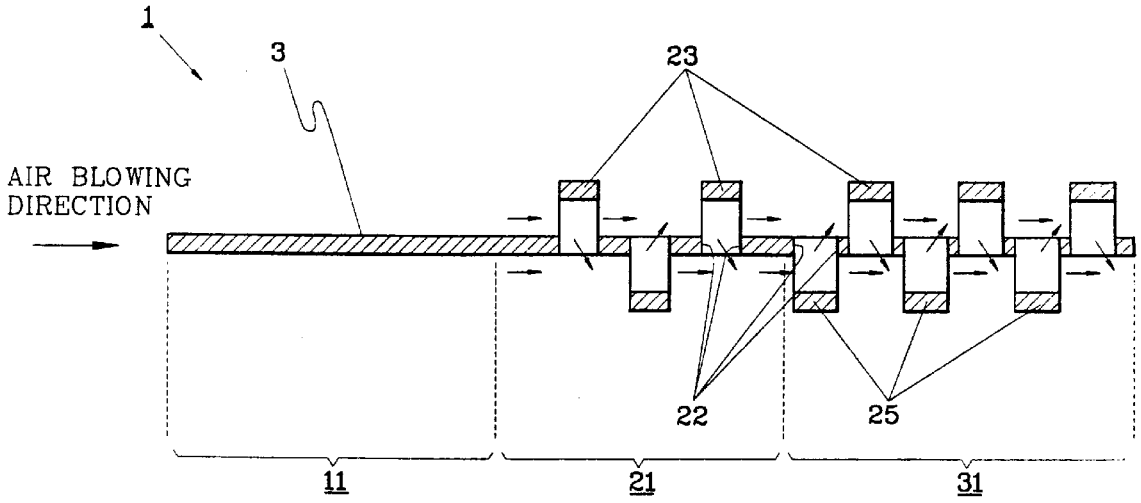
FIG. 3 is an enlarged sectional view taken along line I—I of FIG. 1.
Figure 2:
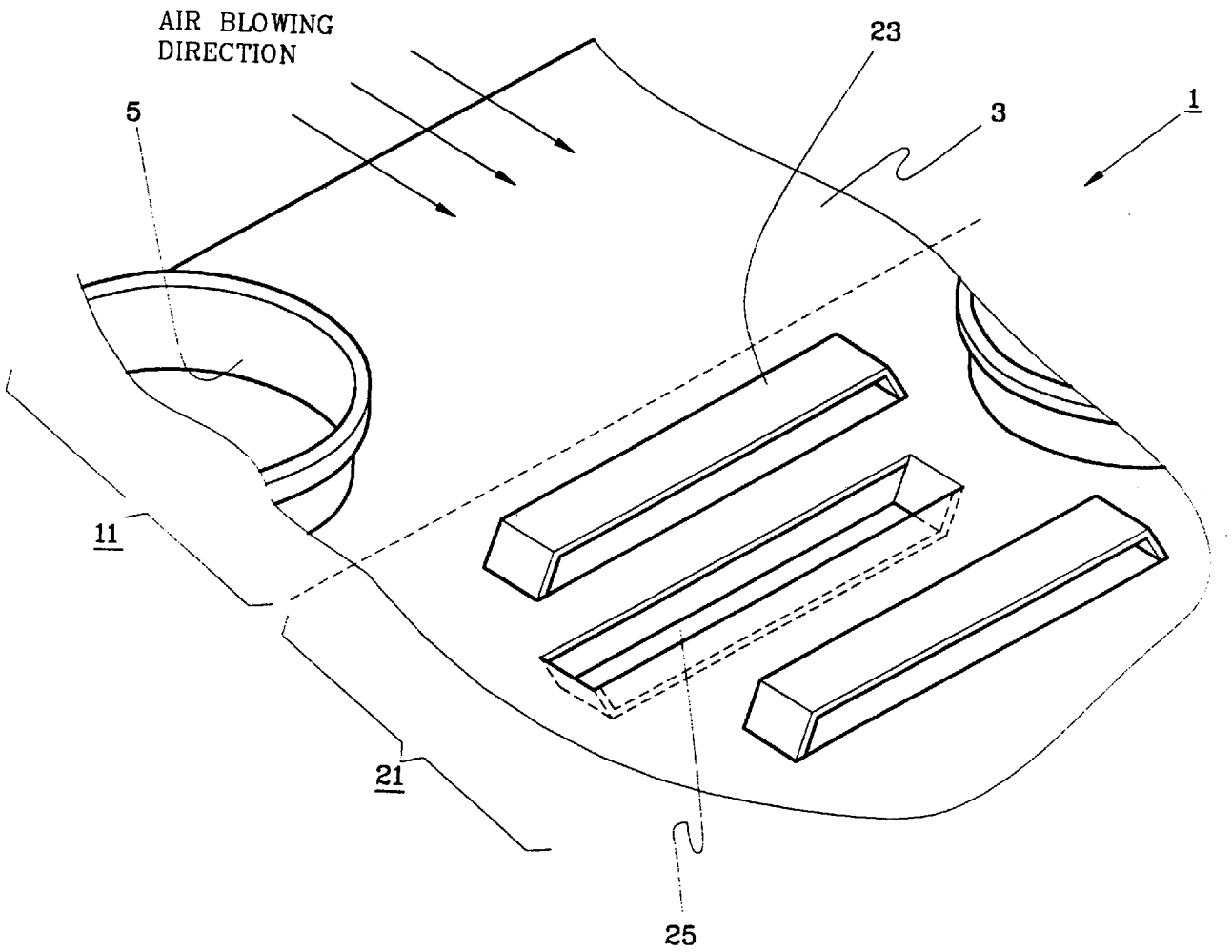
FIG. 2 is a partially enlarged perspective view of FIG. 1.

Preferred embodiments of the present invention will be described in detail with reference to the accompanying drawings. As shown in FIGS. 1 through 3, a plurality of throughholes 5 for the passage of heat exchange tubes through which a coolant passes are formed in a plate-shaped fin 1. The throughholes 5 are arranged in three rows over the width of the fin 1. Thus, the heat exchange tubes passing through the throughholes 5 are also arranged in three rows. As a result, the fin 1 is sectioned into three fin sections 11, 21 and 31 to which respective rows of the heat exchange tubes belong.

A first fin section 11 at the leading end of the air blowing direction, that is, at the upstream or entrance side is provided in flat form, i.e., no slit protuberance portions are formed in the fin base 3. A plurality of slit protuberance portions 23 and 25 protrude from the fin base 3 to define slits 22 extending transversely with respect to an air blowing direction. The slit protuberance portions 23 and 25 are formed in second and third fin sections 21 and 31 sequentially following the first fin section 11. The slit protuberance portions 23 and 25 are formed in an arc form along the circumference of each of the throughholes 5.

The slit protuberance portions 23 and 25 protrude from respective surfaces of the fin base 3 alternately, to thereby form so-called Z-type slit protuberance portions. The respective slit protuberance portions 23 and 25 are spaced by a predetermined distance from each other.

As shown in the drawings, the number of the slit protuberance portions 23 and 25 formed in the second fin section 21 is smaller than the number formed in the third fin section 31. In this embodiment, six slit protuberance portions 23 and 25 are formed in the third fin section 31, and three slit protuberance portions 23 and 25 are formed in the second fin section 21, which corresponds to 50% of the number of the slit protuberance portions 23 and 25 formed in the third fin section 31.

By this structure, the number of the slit protuberance portions of the fin 1 increases gradually from the upstream side to the downstream side of the fin. As a result, the air blowing toward the fin 1 flows with relatively low air flow resistance in the first (upstream) fin section 11. A heat transfer area in the second (intermediate) fin section 21 increases due to the presence of slit protuberance portions 23 and 25, compared to the first fin section 11. A heat transfer area in the third (downstream) fin section 31 further increases due to the further increased number of slit protuberance portions 23 and 25, compared to the second fin section 21. Accordingly, a small air flow resistance and a small heat transfer area are maintained at the air inlet portion, that is, at the upstream portion where the difference in temperature between the blown air and the coolant is large. Meanwhile, an increased air flow resistance and a large heat transfer area are provided at the downstream side where the difference in temperature between the blown air and the coolant is smaller. As a result, the amount of the heat transfer over the whole surface of the fin becomes uniform.

Also, although some frost is formed in the heat exchanger, the heat exchange in the first fin section 11 (and thus the amount of frost) is reduced since there are no slit protuberance portions in the first fin section 11. Thus, the heat exchanger can operate for a long time to improve a performance or efficiency thereof.

Figure 4:
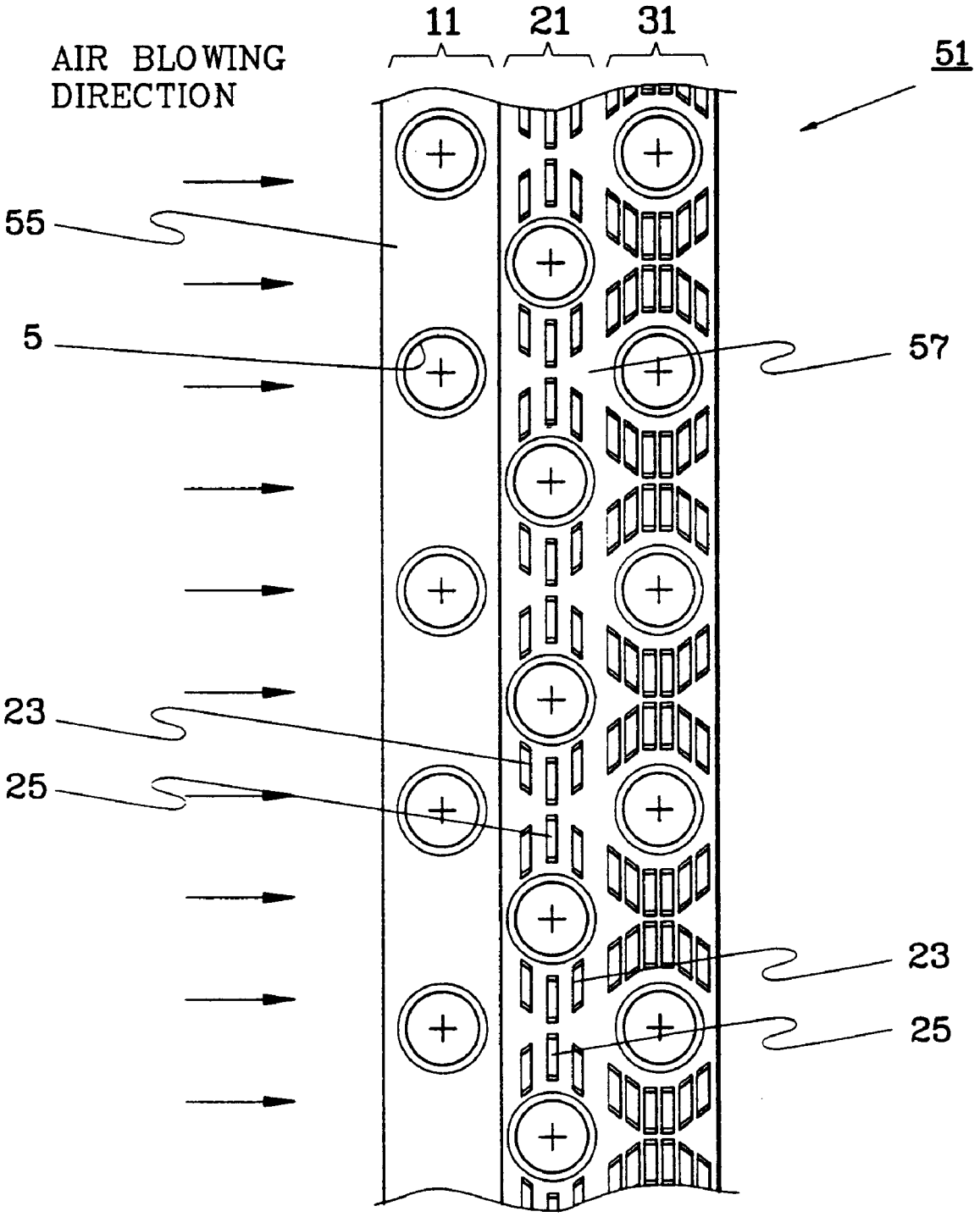
FIG. 4 is a plan view partially showing a fin for use in a heat exchanger according to another embodiment of the present invention.
Figure 5:
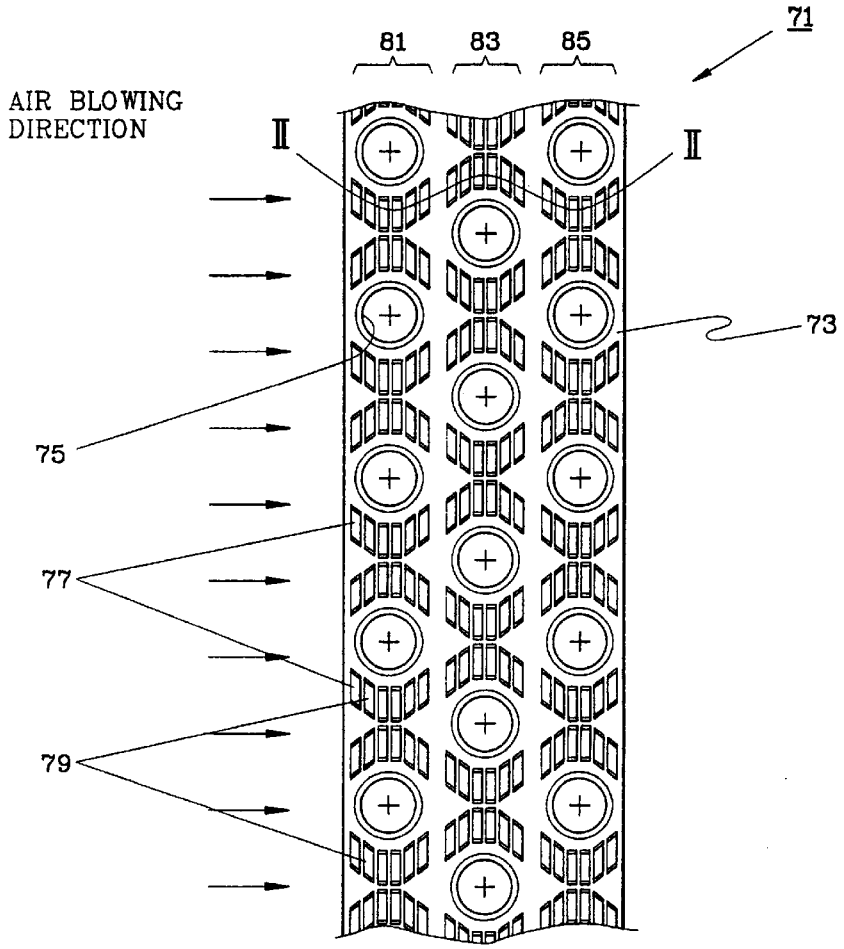
FIG. 5 (PRIOR ART)
FIG. 5 is a plan view partially showing a conventional fin for use in a heat exchanger.
Figure 6:
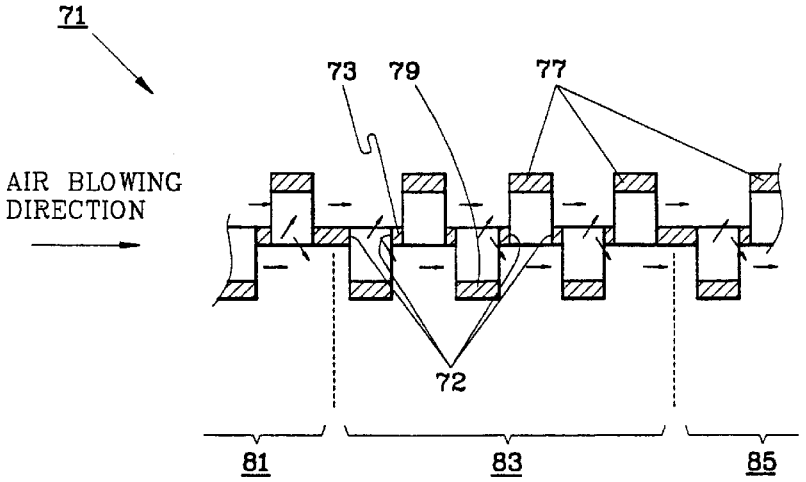
FIG. 6 (PRIOR ART)
FIG. 6 is a partially enlarged sectional view taken along line II—II of FIG. 5.

FIG. 4 is a plan view of a fin 51 according to another embodiment of the present invention. In this embodiment, a first fin section 11 having no slit protuberance portions is separately fabricated with respect to the second and third fin sections 21 and 31. The separately fabricated first fin section 11 is combined with the second fin section 21 by a weld in edge-to-edge fashion to provide a continuous (gap-free) fin surface as shown in FIG. 4. If the portion 11 having no slit protuberance portions is separately fabricated, a production cost for forming the slit protuberance portions can be reduced.

As described above, the heat exchanger according to the present invention enables a uniform heat exchange over the whole surface of the fin, to thereby improve a heat exchange efficiency.

What is claimed is:

1. A heat exchanger comprising:

a plurality of parallel plate-shaped fins spaced apart to define air-flow spaces therebetween, each fin including an upstream side and a downstream side with reference to an air flow direction; and a plurality of parallel exchange tubes extending perpendicularly through the fins, there being at least three rows of the tubes, the rows arranged sequentially from an upstream side to a downstream side of each fin, the first, second and third rows disposed in first, second and third sections, respectively, of each fin, the first and third sections defining the upstream and downstream sides, respectively, of the fin, the second section situated intermediate the first and third sections, each of the second and third sections including slit protuberance portions formed in the fin to define slits extending transversely of the air flow direction, the number of slit protuberance portions in the second section being from about 50% to about 80% of the number of slit protuberance portions in the third section, the first section being free of slits and slit protuberance portions.

2. The heat exchanger according to claim 1 wherein at least one of the fin sections is separate from the others and is rigidly connected thereto to define a continuous fin surface.

3. The heat exchanger according to claim 2 wherein the at least one fin section is the first section.

4. The heat exchanger according to claim 2 wherein the slit protuberance portions are arranged to form arc-shaped patterns which curve around peripheries of the tubes.

* * * * *